US006335713B1

(12) United States Patent
Imai

(10) Patent No.: US 6,335,713 B1
(45) Date of Patent: Jan. 1, 2002

(54) DRIVE APPARATUS WHICH DETECTS SPATIAL CHARGE VOLTAGE ON CHARGE STORAGE LIGHT-EMITTING DEVICE AND CONTROLS VOLTAGE AND CURRENT BASED ON THE DETECTION WHILE DRIVE CURRENT IS BLOCKED

(75) Inventor: Kunio Imai, Tsurugashima (JP)

(73) Assignee: Pioneer Electric Corporation, Tokyo (JP)

( * ) Notice: Subject to any disclaimer, the term of this patent is extended or adjusted under 35 U.S.C. 154(b) by 0 days.

(21) Appl. No.: 09/272,328

(22) Filed: Mar. 19, 1999

(30) Foreign Application Priority Data

Mar. 19, 1998 (JP) ..... 10-070988

(51) Int. Cl.[7] ..... G09G 3/30; G09G 5/00; G09G 3/10

(52) U.S. Cl. ..... 345/76; 345/204; 315/169.3

(58) Field of Search ..... 345/36, 38, 39, 345/44, 45, 46, 55, 76, 77, 78, 82, 87, 90, 91, 92, 204, 214, 212, 215, 101, 211; 315/169.3, 291; 340/825.81, 825.82; 348/800, 801; 365/110, 111; 40/544; 327/520

(56) References Cited

U.S. PATENT DOCUMENTS

| | | | | | |
|---|---|---|---|---|---|
| 4,068,148 | A | * | 1/1978 | Nomiya et al. | 315/169.3 |
| 4,403,157 | A | * | 9/1983 | Guajardo et al. | 327/520 |
| 5,027,036 | A | * | 6/1991 | Ikarashi et al. | 315/169.3 |
| 5,519,288 | A | * | 5/1996 | Tatsumi et al. | 315/169.3 |
| 5,717,437 | A | * | 2/1998 | Sano et al. | 345/211 |
| 5,723,950 | A | * | 3/1998 | Wei et al. | 315/169.3 |
| 5,982,104 | A | * | 11/1999 | Sasaki et al. | 315/169.3 |
| 6,072,477 | A | * | 6/2000 | Ueno | 345/211 |
| 6,084,579 | A | * | 7/2000 | Hirano | 345/205 |

* cited by examiner

*Primary Examiner*—Steven Saras
*Assistant Examiner*—Paul A. Bell
(74) *Attorney, Agent, or Firm*—Sughrue, Mion, Zinn, Macpeak & Seas, PLLC

(57) ABSTRACT

A drive apparatus for a charge storage light-emitting device which comprises drive-voltage applying means for applying a drive voltage to the charge storage light-emitting device, drive-current limiting means for limiting a drive current to be supplied to the charge storage light-emitting device, voltage detection means for detecting a terminal voltage between both electrode terminals of the charge storage light-emitting device, and voltage control means for controlling a value of the drive voltage in accordance with the detection result as a spatial charge voltage from the voltage detection means.

26 Claims, 3 Drawing Sheets

DRIVE APPARATUS WHICH DETECTS SPATIAL CHARGE VOLTAGE ON CHARGE STORAGE LIGHT-EMITTING DEVICE AND CONTROLS VOLTAGE AND CURRENT BASED ON THE DETECTION WHILE DRIVE CURRENT IS BLOCKED

BACKGROUND OF THE INVENTION

1. Field of the Invention

The present invention relates to an apparatus and method for driving a light-emitting device, and, more particularly, to a technology for controlling the luminance of light emitted from a charge storage light-emitting device.

2. Description of the Related Art

An organic electroluminescence (hereinafter referred to as organic EL or simply EL) device as a charge storage light-emitting device emits light by permitting current to flow through a phosphor (organic EL layer) formed on a glass plate, as a transparent substrate, or a transparent organic film. A variety of display apparatuses using such organic EL devices have been proposed.

Organic EL devices which can emit lights independently pixel by pixel are arranged on an image display. Each of the organic EL devices generally has the same structure where an ITO (anode) layer, a light-emitting layer (organic EL layer) and a cathode are deposited in order on a transparent substrate. They are also common in emitting light with an instantaneous luminance proportional to the drive current.

While a scheme called simple matrix driving is known as one method of driving an organic EL device, various other schemes involving active matrix driving have also been proposed.

The active matrix driving, which is accomplished by using TFTs (Thin Film Transistors), can provide EL devices with an excellent memory property (emission keeping property) which could not be achieved by the simple matrix driving.

More specifically, according to the active matrix driving, the drive current is supplied to an EL device from a drive voltage source through a TFT of which switching action permits ON/OFF of light emission. Weighting of the luminance of emitted light for gray scale displaying is done by amplitude modulation or time modulation (so-called subfielding).

The amplitude modulation is a scheme to adjust the instantaneous luminance of an EL device by controlling the drive voltage (drive current) with a constant emission time. That is, the amplitude modulation is based on an idea of controlling the intensity of emitted light to provide a desired luminance level.

The time modulation is a scheme of controlling the emission time in each predetermined period (one field period) with the instantaneous luminance of an EL device which is a constant. That is, the time modulation is based on an idea of acquiring the apparent luminance by controlling the emission rate to provide a desired luminance level.

For the time modulation, which requires a constant instantaneous luminance all the time, a constant voltage power source is normally used for the drive voltage source for an EL device.

However, the drive voltage—drive current characteristic of an organic EL device varies depending on the ambient temperature as shown in FIG. 1. A temperature change leads to a variation in drive current, thereby changing the instantaneous luminance. With the same voltage applied to an organic EL device, therefore, the intensity of emitted light increases at a certain temperature but decreases at a different temperature.

Since the variation in instantaneous luminance impairs the linearity of a gray scale, an accurate gray-scale image is not always displayed on an image display using the EL devices.

SUMMARY OF THE INVENTION

Accordingly, it is an object of the present invention to provide a drive apparatus and drive method for a charge storage light-emitting device, which can keep the luminance of emitted light at a constant level even when an operational temperature varies.

To achieve this object, a drive apparatus according to one aspect of the present invention comprises drive-voltage applying means for applying a drive voltage to the charge storage light-emitting device; drive-current limiting means for limiting a drive current to be supplied to the charge storage light-emitting device; voltage detection means for detecting a terminal voltage between both electrode terminals of the charge storage light-emitting device; and voltage control means for controlling a value of the drive voltage in accordance with a result of detection performed by the voltage detection means.

In the drive apparatus, the voltage detection means may be designed to detect the terminal voltage in a state of blocking supply of the drive current to the charge storage light-emitting device after the drive current has been supplied to the charge storage light-emitting device by applying the drive voltage to the charge storage light-emitting device.

In any of the modes of the drive apparatus, the voltage control means may be designed to control the drive voltage in such a way that a voltage value acquired by subtracting the terminal voltage from the drive voltage becomes a predetermined value.

In any of the modes of the drive apparatus, the drive-current limiting means may be comprised of a switching transistor.

To achieve the above object, according to another aspect of the present invention, a drive apparatus for a charge storage light-emitting device for applying a drive voltage to the charge storage light-emitting device to supply a drive current thereto, thereby causing the charge storage light-emitting device to emit light, comprises spatial-charge-voltage detection means for detecting a spatial charge voltage of the charge storage light-emitting device.

The drive apparatus may further comprise voltage control means for controlling the drive voltage in such a way that a voltage value acquired by subtracting the spatial charge voltage from the drive voltage becomes a predetermined value.

In the drive apparatus, an organic EL device may be used as the charge storage light-emitting device.

To achieve the above object, according to a further aspect of the present invention, a drive method for a charge storage light-emitting device for applying a drive voltage to the charge storage light-emitting device to supply a drive current thereto, thereby causing the charge storage light-emitting device to emit light, comprises the steps of, after supplying the drive current to the charge storage light-emitting device by applying the drive voltage thereto, blocking supply of the drive current to the charge storage light-emitting device with the drive voltage being still applied thereto; detecting a terminal voltage between both electrode terminals of the charge storage light-emitting device immediately after the supply of the drive current is blocked; and controlling the drive voltage in such a way that a voltage value acquired by subtracting a value of the terminal voltage from a value of the drive voltage becomes a predetermined value.

To achieve the object, according to a still further aspect of the present invention, a drive method for a charge storage light-emitting device for applying a drive voltage to the charge storage light-emitting device to supply a drive current thereto, thereby causing the charge storage light-emitting device to emit light, comprises the steps of detecting a spatial charge voltage of the charge storage light-emitting device; and controlling the drive voltage in such a way that a voltage value acquired by subtracting a value of the spatial charge voltage from a value of the drive voltage becomes a predetermined value.

In any mode of the drive methods, an organic EL device may be used as the charge storage light-emitting device.

DETAILED DESCRIPTION OF THE PREFERRED EMBODIMENT

A preferred embodiment of the present invention will now be described specifically referring to the accompanying drawings.

The spatial charge voltage which is one of the features of this embodiment will be first discussed.

As a drive voltage is applied to an EL device to cause light emission, a predetermined amount of charges are retained in the EL device. The potential provided by the stored charges (spatial charge) is the spatial charge voltage.

The spatial charge is obtained as follows.

Spatial charge=Injected charges−Consumed charges (charges to be converted to light or heat).

The spatial charge voltage Vs is given by the following equation using a drive voltage (load voltage) Vd and a conduction voltage Vc (which contributes to emission).

$$Vs=Vd-Vc$$

Figure 1:
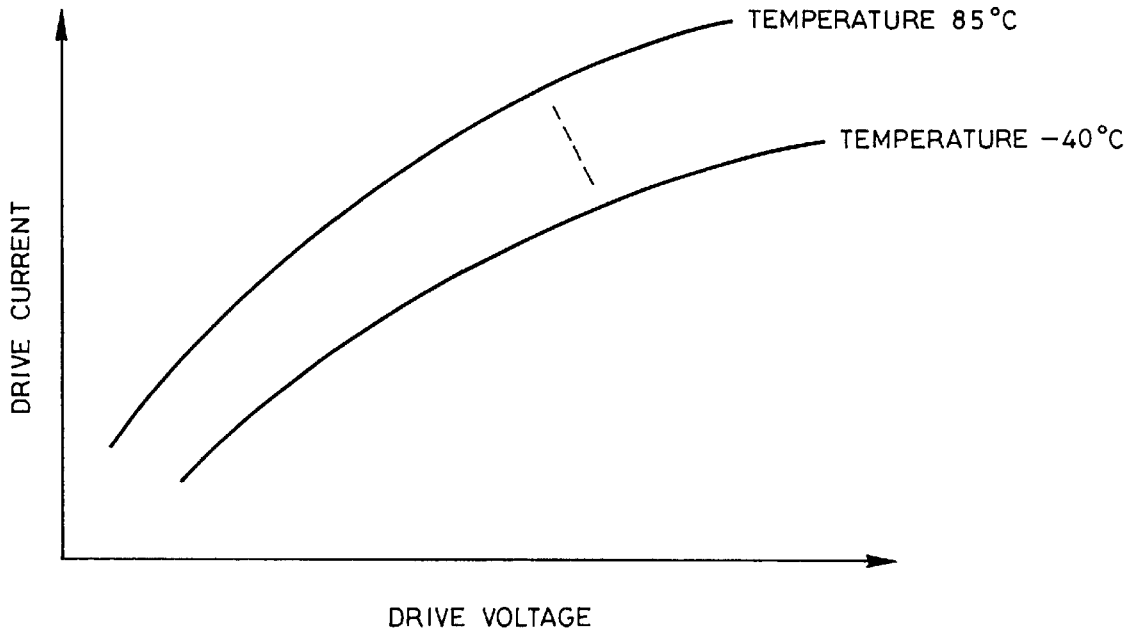
FIG. 1 is a graph showing the drive voltage-drive current characteristic of an EL device.
Figure 2:
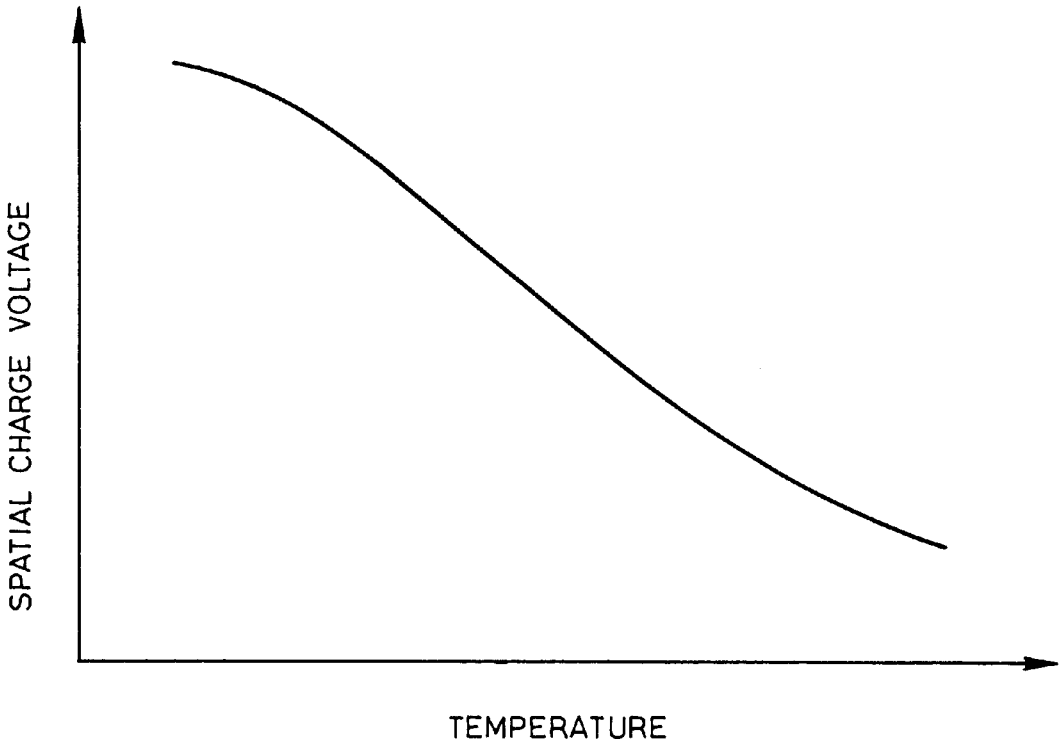
FIG. 2 is a graph showing the relationship between the ambient temperature of an EL device and the amount of spatial charges thereof.

The present inventors discovered that the spatial charge voltage defined above is dependent on the temperature. The inventors also confirmed that the temperature dependency of the spatial charge voltage greatly affects the temperature dependency of the drive voltage for an EL device. One of the proofs is that the spatial charge voltage of an EL device varies in accordance with change in ambient temperature, while the conduction voltage hardly varies. The graph in FIG. 2 shows the relationship between the ambient temperature and the amount of spatial charges.

A drive apparatus to be discussed below utilizes such a characteristic of the spatial charge voltage, and suppresses a variation in the instantaneous luminance of an EL device by controlling the drive voltage so as to make the conduction voltage at a constant voltage after detecting the spatial charge voltage.

Figure 3:
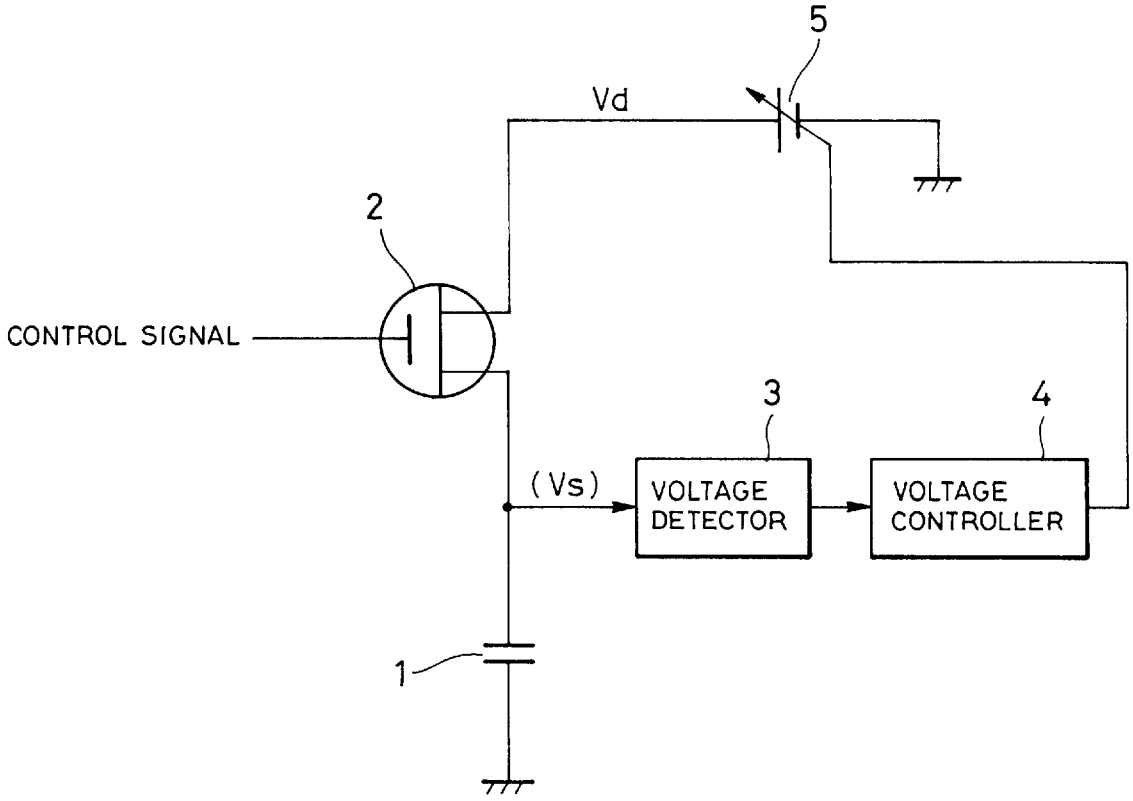
FIG. 3 is a block diagram illustrating the constitution of a drive circuit for an EL device corresponding to one unit pixel of a display system according to one embodiment of the present invention.

FIG. 3 shows the partly schematic constitution of an emission display which uses organic EL devices.

In FIG. 3, an organic EL device 1 is shown as an equivalent capacitor. One electrode of the EL device 1 is grounded, while the other electrode is connected to the drain terminal of an FET (Field Effect Transistor) 2 as drive-current limiting means, and a voltage detector 3.

The voltage detector 3, which serves as voltage detection means and spatial-charge-voltage detection means, detects the value of the voltage between both electrodes of the EL device 1, and supplies the drive voltage controller 4 with a voltage detection signal corresponding to the detected level. In accordance with the voltage detection signal, the drive voltage controller 4 controls the variable voltage source 5 serving as drive-voltage applying means.

The negative pole of the variable voltage source 5 is grounded, while the positive pole is connected to the source of the FET 2. An output voltage value of the variable voltage source 5 or a value of the drive voltage to be supplied to the EL device 1 is set by the drive voltage controller 4.

The FET 2, which serves as switching means for controlling the emission (ON)/non-emission (OFF) of the EL device 1, controls emission of the EL device 1 based on its own switching action for the enabled state or disabled state corresponding to a control signal that is supplied to the gate of the FET 2. In accordance with the control signal input to the gate, the FET 2 can implement luminance control. More specifically, the FET 2 can perform an amplitude modulation operation to control the amount of current which flows in the EL device 1 in accordance with the gate input control signal or can perform a time modulation operation to control the amount of time and timing for permitting the current to flow in the EL device 1 in accordance with the gate input control signal.

FIG. 3 shows the EL device 1 corresponding to one unit pixel and the peripheral constitution thereof. Multiple such EL devices are arranged on the display panel in a matrix form, and their peripheral circuits are formed in association with the matrix of EL devices.

The FET 2 may be replaced with another type of switching transistor.

The operation of the thus constituted charge storage light-emitting device will be discussed in detail.

In the case of time modulation, when a high-level control signal is supplied to the gate of the FET 2, the FET 2 is enabled, allowing the drive current from the variable voltage source 5 to flow into the EL device 1 in a high-level duration of the control signal. This causes the EL device 1 to emit light over the high-level duration.

When a low-level control signal is supplied to the gate of the FET 2, on the other hand, the FET 2 is disabled, blocking the drive current from the variable voltage source 5. This disables light emission of the EL device 1.

The high-level duration of the control signal and its timing are set to provide a desired luminance level based on the time modulation scheme. Namely, a luminance level for a gray scale is weighted by the high-level duration of the control signal in one frame period of a displayed image.

The aforementioned detection of the spatial charge voltage is accomplished by measuring the voltage between both electrodes of the EL device 1 by means of the voltage detector 3 just after the EL device 1 changes its state to a non-emission state from an emission state. More specifically, the voltage between both electrodes of the EL device 1 is detected when supply of the drive current to the EL device 1 after the drive voltage from the variable voltage source 5 is applied to the EL device 1 to supply the drive current thereto, preferably immediately after this current blocking state takes places.

Since no current flows in the EL device 1 right after the state transition of the EL device 1 to the non-emission state, the aforementioned consumed charges (conduction voltage) are equal to zero, so that the voltage between both electrodes of the EL device 1 is produced by the internal spatial charges. That is, the voltage between both electrodes of the EL device 1 just after the state transition of the EL device 1 to the non-emission state becomes the spatial charge voltage, which is detected by the voltage detector 3.

The value of the conduction voltage to be applied to the EL device 1 is determined in accordance with a desired instantaneous luminance. Thus, the value of the drive voltage Vd is determined by adding the value of the detected spatial charge voltage Vs to the conduction voltage value Vc. In other words, the value of the drive voltage Vd is obtained in such a manner that a voltage value acquired by subtracting the voltage between both electrodes of the EL device 1 equivalent to the spatial charge voltage Vs of the EL device 1 from the drive voltage Vd becomes a predetermined value corresponding to the desired instantaneous luminance. Since the spatial charge voltage depends on the ambient temperature as mentioned earlier, the value of the drive voltage determined in such a manner is adequate to acquire the desired instantaneous luminance compensated based on the temperature.

The drive voltage value is determined by the drive voltage controller 4. The drive voltage controller 4 controls the variable voltage source 5 so as to provide the determined drive voltage value.

The adjustment of the drive voltage may always be implemented in responsive to the ambient temperature or the spatial charge voltage. With the temperature hardly changing, particularly for an image display apparatus which generally uses the EL devices, the adjustment of the drive voltage may be performed as needed, for example, when the apparatus is powered on.

According to the above embodiment, the temperature compensation of the EL device 1 is carried out, so that a temperature-dependent variation in instantaneous luminance is suppressed. This can ensure accurate gray-scale display.

Although the drive operation in the embodiment discussed above is based on time modulation, it does not mean that the present invention excludes the amplitude-modulated based drive operation.

Although the foregoing description of the embodiment has been given on an apparatus using organic EL devices, the present invention may be adapted to other types of charge storage light-emitting devices.

Further, while the above embodiment uses the detected spatial charge voltage of the EL device in controlling the drive voltage, the present invention is not limited to the particular embodiment, but may use the detected spatial charge voltage as the monitor output resulting from monitoring the operational temperature status. The present invention is advantageous in this respect.

Although explanation of various means and steps in this embodiment and modifications described above appears restrictive, it should be apparent to those skilled in the art that such means and steps may be modified in other specific forms as needed within the spirit or scope of the invention.

As specifically described above, the present invention can provide a drive apparatus and drive method for a charge storage light-emitting device, which can keep the luminance of emitted light constant even when the operational temperature varies.

What is claimed is:

1. A drive apparatus for a charge storage light-emitting device comprising:

drive-voltage applying means for applying a drive voltage to said charge storage light-emitting device;

drive-current limiting means for limiting a drive current to be supplied to said charge storage light-emitting device;

voltage detection means for detecting a terminal voltage between both electrode terminals of said charge storage light-emitting device; and voltage control means for controlling a value of said drive voltage in accordance with a result of detection performed by said voltage detection means.

2. The drive apparatus according to claim 1, wherein said voltage detection means detects said terminal voltage in a state of blocking supply of said drive current to said charge storage light-emitting device after said drive current has been supplied to said charge storage light-emitting device by applying said drive voltage to said charge storage light-emitting device.

3. The drive apparatus according to claim 1, wherein said voltage control means controls said drive voltage in such a way that a voltage value acquired by subtracting said terminal voltage from said drive voltage becomes a predetermined value.

4. The drive apparatus according to claim 1, wherein said drive-current limiting means is comprised of a switching transistor.

5. The drive apparatus according to claim 1, wherein said charge storage light-emitting device is an organic electroluminescence device.

6. The drive apparatus according to claim 1, wherein said voltage detection means outputs said result to said voltage control means, and wherein said voltage control means outputs a control signal to said drive-voltage applying means based on said result.

7. The drive apparatus according to claim 6, wherein said drive-voltage applying means adjusts said value of said drive voltage based on said control signal.

8. A drive apparatus for a charge storage light-emitting device for applying a drive voltage to said charge storage light-emitting device to supply a drive current thereto, thereby causing said charge storage light-emitting device to emit light, said apparatus comprising:

spatial-charge-voltage detection means for detecting a spatial charge voltage of said charge storage light-emitting device.

9. The drive apparatus according to claim 8, further comprising voltage control means for controlling said drive voltage in such a way that a voltage value acquired by subtracting said spatial charge voltage from said drive voltage becomes a predetermined value.

10. The drive apparatus according to claim 8, wherein said charge storage light-emitting device is an organic electroluminescence device.

11. A drive method for a charge storage light-emitting device for applying a drive voltage to said charge storage light-emitting device to supply a drive current thereto, thereby causing said charge storage light-emitting device to emit light, said method comprising the steps of:

after supplying said drive current to said charge storage light-emitting device by applying said drive voltage thereto, blocking supply of said drive current to said charge storage light-emitting device with said drive voltage being still applied thereto;

detecting a terminal voltage between both electrode terminals of said charge storage light-emitting device immediately after said supply of said drive current is blocked; and controlling said drive voltage in such a way that a voltage value acquired by subtracting a value of said terminal voltage from a value of said drive voltage becomes a predetermined value.

12. The drive method according to claim 11, wherein said charge storage light-emitting device is an organic electroluminescence device.

13. A drive method for a charge storage light-emitting device for applying a drive voltage to said charge storage light-emitting device to supply a drive current thereto, thereby causing said charge storage light-emitting device to emit light, said method comprising the steps of:

detecting a spatial charge voltage of said charge storage light-emitting device; and controlling said drive voltage in such a way that a voltage value acquired by subtracting a value of said spatial charge voltage from a value of said drive voltage becomes a predetermined value.

14. The drive method according to claim 13, wherein said charge storage light-emitting device is an organic electroluminescence device.

15. A drive apparatus for a light-emitting device, comprising:

a drive source that generates a drive signal for driving said light-emitting device;

a drive signal transfer circuit that inputs said drive signal and selectively outputs said drive signal to said light-emitting device;

a detection circuit that detects a signal value across said light-emitting device and outputs a corresponding detection signal; and a controller that inputs said detection signal and outputs a control signal to said drive source based on said detection signal, wherein said drive source adjusts said drive signal based on said control signal.

16. The drive apparatus as claimed in claim 15, wherein said drive signal comprises a drive voltage and said signal value constitutes a value of a spatial charge voltage stored in said light-emitting device.

17. The drive apparatus as claimed in claim 16, wherein said detection circuit detects said spatial charge voltage and outputs said detection signal based on said spatial charge voltage, and wherein said controller inputs said detection signal and outputs said control signal to instruct said drive source to adjust a drive voltage value of said drive voltage such that a difference between said drive voltage value and said spatial charge value substantially equals a predetermined voltage value.

18. The drive apparatus as claimed in claim 15, wherein said drive signal comprises a drive voltage having a drive voltage value, wherein said signal value comprises a signal voltage value, wherein said detection circuit detects said signal voltage value and outputs said detection signal based on said signal voltage value, and wherein said controller inputs said detection signal and outputs said control signal to instruct said drive source to adjust said drive voltage value such that a difference between said drive voltage value and said signal voltage value equals a predetermined voltage value.

19. The drive apparatus as claimed in claim 15, wherein said drive signal comprises a drive current, wherein said drive signal transfer circuit selectively outputs said drive current to said light-emitting device, and wherein said detection circuit detects said signal value across said light-emitting device and outputs said detection signal after said drive signal transfer circuit has previously output said drive current to said light-emitting device and when said drive signal transfer circuit is currently preventing said drive current from being applied to said light-emitting device.

20. The drive apparatus as claimed in claim 19, wherein said signal value is a value of a spatial charge voltage stored in said light-emitting device.

21. A method of driving apparatus for a light-emitting device, comprising:

(a) generating a drive signal for driving said light-emitting device;

(b) selectively outputting said drive signal to said light-emitting device;

(c) detecting a signal value across said light-emitting device after said drive signal is output to said light emitting device;

(d) generating a detection signal based on said signal value; and (e) adjusting a drive signal value of said drive signal based on said detection signal, wherein said drive signal value is adjusted such that a difference between said drive signal value and said signal value substantially equals a predetermined value.

22. The method as claimed in claim 21, wherein said drive signal comprises a drive voltage and said signal value comprises a value of a spatial charge voltage stored in said light-emitting device.

23. The method as claimed in claim 22, wherein said operation (d) comprises:

(d1) detecting said spatial charge voltage; and (d2) outputting said detection signal based on said spatial charge voltage.

24. The method as claimed in claim 21, wherein said drive signal comprises a drive voltage having a drive voltage value, wherein said signal value comprises a signal voltage value, wherein said operation (d) comprises:

(d1) detecting said signal voltage value; and (d2) outputting said detection signal based on said signal voltage value, and wherein said operation (e) comprises:

(e1) adjusting said drive voltage value such that a difference between said drive voltage value and said signal voltage value equals a predetermined voltage value.

25. The method as claimed in claim 21, wherein said drive signal comprises a drive current, wherein said operation (b) comprises:

(b1) selectively outputting said drive current to said light-emitting device, and wherein said operation (d) comprises:

(d1) detecting said signal value across said light-emitting device after said drive current has been previously output to said light-emitting device and when said drive current is currently not being applied to said light-emitting device.

26. The method as claimed in claim 25, wherein said signal value is a value of a spatial charge voltage stored in said light-emitting device.

* * * * *